US007494355B2

(12) United States Patent
Hughes et al.

(10) Patent No.: US 7,494,355 B2
(45) Date of Patent: Feb. 24, 2009

(54) THERMOPLASTIC INTERFACE AND SHIELD ASSEMBLY FOR SEPARABLE INSULATED CONNECTOR SYSTEM

(75) Inventors: David Charles Hughes, Rubicon, WI (US); John M. Makal, Menomonee Falls, WI (US); Edine Mary Heinig, Pewaukee, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/676,861

(22) Filed: Feb. 20, 2007

(65) Prior Publication Data

US 2008/0200053 A1 Aug. 21, 2008

(51) Int. Cl.
*H01R 13/53* (2006.01)

(52) U.S. Cl. ..... 439/181; 439/921

(58) Field of Classification Search ..... 439/181, 439/184, 183, 185, 921, 205
See application file for complete search history.

(56) References Cited

U.S. PATENT DOCUMENTS

| | | | |
|---|---|---|---|
| 1,903,956 | A | 4/1933 | Christie et al. |
| 2,953,724 | A | 9/1960 | Hilfiker et al. |
| 3,115,329 | A | 12/1963 | Wing et al. |
| 3,315,132 | A | 4/1967 | Raymond |
| 3,392,363 | A | 7/1968 | Geis, Jr. et al. |
| 3,471,669 | A | 10/1969 | Curtis |
| 3,474,386 | A | 10/1969 | Link |
| 3,509,516 | A | 4/1970 | Phillips |
| 3,509,518 | A | 4/1970 | Phillips |
| 3,513,425 | A | 5/1970 | Arndt |
| 3,539,972 | A | 11/1970 | Silva et al. |
| 3,542,986 | A | 11/1970 | Kotski |
| 3,546,535 | A | 12/1970 | Van Riemsdijk |
| 3,576,493 | A | 4/1971 | Tachick et al. |
| 3,594,685 | A | 7/1971 | Cunningham |
| 3,652,975 | A | 3/1972 | Keto |
| 3,654,590 | A | 4/1972 | Brown |
| 3,663,928 | A | 5/1972 | Keto |
| 3,670,287 | A | 6/1972 | Keto |
| 3,678,432 | A | 7/1972 | Boliver |
| 3,720,904 | A | 3/1973 | De Sio |
| 3,725,846 | A | 4/1973 | Strain |
| 3,740,503 | A | 6/1973 | Tomohiro et al. |
| 3,740,511 | A | 6/1973 | Westmoreland |
| 3,798,586 | A | 3/1974 | Huska |
| 3,826,860 | A | 7/1974 | De Sio et al. |

(Continued)

FOREIGN PATENT DOCUMENTS

| | | |
|---|---|---|
| DE | 3110609 | 10/1982 |

(Continued)

OTHER PUBLICATIONS

Cooper Power Systems, Product Literature, Loadbreak Apparatus Connectors, 200 A 25 kV Class Loadbreak Bushing Insert (Service Information 500-26), Jan. 2002, 2 pages.

(Continued)

*Primary Examiner*—Neil Abrams
*Assistant Examiner*—Phuong Nguyen
(74) *Attorney, Agent, or Firm*—King & Spalding

(57) ABSTRACT

A separable insulated connector assembly provided with a thermoplastic interface formed on a surface of a shield.

56 Claims, 7 Drawing Sheets

U.S. PATENT DOCUMENTS

| | | | |
|---|---|---|---|
| 3,845,233 | A | 10/1974 | Burton |
| 3,860,322 | A | 1/1975 | Sankey et al. |
| 3,915,534 | A | 10/1975 | Yonkers |
| 3,924,914 | A | 12/1975 | Banner |
| 3,945,699 | A | 3/1976 | Westrom |
| 3,949,343 | A | 4/1976 | Yonkers |
| 3,953,099 | A | 4/1976 | Wilson |
| 3,955,874 | A | 5/1976 | Boliver |
| 3,957,332 | A | 5/1976 | Lambert, III |
| 3,960,433 | A | 6/1976 | Boliver |
| 4,029,380 | A | 6/1977 | Yonkers |
| 4,040,696 | A | 8/1977 | Wada et al. |
| 4,067,636 | A | 1/1978 | Boliver et al. |
| 4,088,383 | A | 5/1978 | Fischer et al. |
| 4,102,608 | A | 7/1978 | Balkau et al. |
| 4,103,123 | A | 7/1978 | Marquardt |
| 4,107,486 | A | 8/1978 | Evnas |
| 4,113,339 | A | 9/1978 | Eley |
| 4,123,131 | A | 10/1978 | Pearce, Jr. et al. |
| 4,152,643 | A | 5/1979 | Schweitzer |
| 4,154,993 | A | 5/1979 | Kumbera et al. |
| 4,161,012 | A | 7/1979 | Cunningham |
| 4,163,118 | A | 7/1979 | Marien et al. |
| 4,186,985 | A | 2/1980 | Stepniak et al. |
| 4,203,017 | A | 5/1980 | Lee |
| 4,210,381 | A | 7/1980 | Borgstrom |
| 4,223,179 | A | 9/1980 | Lusk et al. |
| 4,260,214 | A | 4/1981 | Dorn |
| 4,343,356 | A | 8/1982 | Riggs et al. |
| 4,353,611 | A | 10/1982 | Siebens et al. |
| 4,354,721 | A | 10/1982 | Luzzi |
| 4,360,967 | A | 11/1982 | Luzzi et al. |
| 4,443,054 | A | 4/1984 | Ezawa et al. |
| 4,463,227 | A | 7/1984 | Dizon et al. |
| 4,484,169 | A | 11/1984 | Nishikawa |
| 4,500,935 | A | 2/1985 | Tsuruta et al. |
| 4,508,413 | A | 4/1985 | Bailey |
| 4,568,804 | A | 2/1986 | Leuhring |
| 4,600,260 | A | 7/1986 | Stepniak et al. |
| 4,626,755 | A | 12/1986 | Butcher et al. |
| 4,638,403 | A | 1/1987 | Amano et al. |
| 4,678,253 | A | 7/1987 | Hicks et al. |
| 4,688,013 | A | 8/1987 | Nishikawa et al. |
| 4,700,258 | A | 10/1987 | Farmer |
| 4,715,104 | A | 12/1987 | Schoenwetter et al. |
| 4,722,694 | A | 2/1988 | Makal et al. |
| 4,767,894 | A | 8/1988 | Schombourg |
| 4,767,941 | A | 8/1988 | Brand et al. |
| 4,779,341 | A | 10/1988 | Roscizewski |
| 4,793,637 | A | 12/1988 | Laipply et al. |
| 4,799,895 | A | 1/1989 | Borgstrom |
| 4,820,183 | A | 4/1989 | Knapp et al. |
| 4,822,291 | A | 4/1989 | Cunningham |
| 4,822,951 | A | 4/1989 | Wilson et al. |
| 4,834,677 | A | 5/1989 | Archang |
| 4,857,021 | A | 8/1989 | Boliver et al. |
| 4,863,392 | A | 9/1989 | Borgstrom et al. |
| 4,867,687 | A | 9/1989 | Williams et al. |
| 4,871,888 | A | 10/1989 | Bestel |
| 4,891,016 | A | 1/1990 | Luzzi et al. |
| 4,911,655 | A | 3/1990 | Pinyan et al. |
| 4,946,393 | A | 8/1990 | Borgstrom |
| 4,955,823 | A | 9/1990 | Luzzi |
| 4,972,049 | A | 11/1990 | Muench |
| 4,982,059 | A | 1/1991 | Bestel |
| 5,025,121 | A | 6/1991 | Allen et al. |
| 5,045,656 | A | 9/1991 | Kojima |
| 5,045,968 | A | 9/1991 | Suzuyama et al. |
| 5,053,584 | A | 10/1991 | Chojnowski |
| 5,101,080 | A | 3/1992 | Ferenc |
| 5,114,357 | A | 5/1992 | Luzzi |
| 5,128,824 | A | 7/1992 | Yaworski et al. |
| 5,130,495 | A | 7/1992 | Thompson |
| 5,166,861 | A | 11/1992 | Krom |
| 5,175,403 | A | 12/1992 | Hamm et al. |
| 5,213,517 | A | 5/1993 | Kerek et al. |
| 5,221,220 | A | 6/1993 | Roscizewski |
| 5,230,142 | A | 7/1993 | Roscizewski |
| 5,230,640 | A | 7/1993 | Tardif |
| 5,248,263 | A | 9/1993 | Sakurai et al. |
| 5,266,041 | A | 11/1993 | De Luca |
| 5,277,605 | A | 1/1994 | Roscizewski et al. |
| 5,356,304 | A | 10/1994 | Colleran |
| 5,358,420 | A | 10/1994 | Cairns et al. |
| 5,359,163 | A | 10/1994 | Woodard |
| 5,393,240 | A | 2/1995 | Makal et al. |
| 5,422,440 | A | 6/1995 | Palma |
| 5,427,538 | A | 6/1995 | Knapp et al. |
| 5,429,519 | A | 7/1995 | Murakami et al. |
| 5,433,622 | A | 7/1995 | Galambos |
| 5,435,747 | A | 7/1995 | Franckx et al. |
| 5,445,533 | A | 8/1995 | Roscizewski et al. |
| 5,468,164 | A | 11/1995 | Demissy |
| 5,492,487 | A | 2/1996 | Cairns et al. |
| 5,525,069 | A | 6/1996 | Roscizewski et al. |
| 5,589,671 | A | 12/1996 | Hackbarth et al. |
| 5,619,021 | A | 4/1997 | Yamamoto et al. |
| 5,641,310 | A | 6/1997 | Tiberio, Jr. |
| 5,655,921 | A | 8/1997 | Makal |
| 5,661,280 | A | 8/1997 | Kuss et al. |
| 5,667,060 | A | 9/1997 | Luzzi |
| 5,717,185 | A | 2/1998 | Smith |
| 5,736,705 | A | 4/1998 | Bestel et al. |
| 5,737,874 | A | 4/1998 | Sipos et al. |
| 5,747,765 | A | 5/1998 | Bestel et al. |
| 5,747,766 | A | 5/1998 | Waino et al. |
| 5,757,260 | A | 5/1998 | Smith et al. |
| 5,766,030 | A | 6/1998 | Suzuki |
| 5,766,517 | A | 6/1998 | Goedde et al. |
| 5,795,180 | A | 8/1998 | Siebens |
| 5,808,258 | A | 9/1998 | Luzzi |
| 5,816,835 | A | 10/1998 | Meszaros |
| 5,846,093 | A | 12/1998 | Muench et al. |
| 5,857,862 | A | 1/1999 | Muench et al. |
| 5,864,942 | A | 2/1999 | Luzzi |
| 5,912,604 | A | 6/1999 | Harvey et al. |
| 5,917,167 | A | 6/1999 | Bestel |
| 5,936,825 | A | 8/1999 | DuPont |
| 5,949,641 | A | 9/1999 | Walker et al. |
| 5,953,193 | A | 9/1999 | Ryan |
| 5,957,712 | A | 9/1999 | Stepniak |
| 6,022,247 | A | 2/2000 | Akiyama et al. |
| 6,040,538 | A | 3/2000 | French et al. |
| 6,042,407 | A | 3/2000 | Scull et al. |
| 6,069,321 | A | 5/2000 | Wagener et al. |
| 6,130,394 | A | 10/2000 | Hogl |
| 6,168,447 | B1 | 1/2001 | Stepniak et al. |
| 6,205,029 | B1 | 3/2001 | Byrne et al. |
| 6,213,799 | B1 | 4/2001 | Jazowski et al. |
| 6,220,888 | B1 | 4/2001 | Correa |
| 6,227,908 | B1 | 5/2001 | Aumeier |
| 6,250,950 | B1 | 6/2001 | Pallai |
| 6,280,659 | B1 | 8/2001 | Sundin |
| 6,332,785 | B1 | 12/2001 | Muench, Jr. et al. |
| 6,338,637 | B1 | 1/2002 | Muench, Jr. et al. |
| 6,362,445 | B1 | 3/2002 | Mearchland et al. |
| 6,364,216 | B1 | 4/2002 | Martin |
| 6,416,338 | B1 | 7/2002 | Berlovan |
| 6,453,776 | B1 | 9/2002 | Beattie et al. |
| 6,504,103 | B1 | 1/2003 | Meyer et al. |
| 6,517,366 | B2 | 2/2003 | Bertini et al. |
| 6,520,795 | B1 | 2/2003 | Jazowski |
| 6,538,312 | B1 | 3/2003 | Peterson et al. |
| 6,542,056 | B2 | 4/2003 | Nerstron et al. |

| | | | | |
|---|---|---|---|---|
| 6,566,996 | B1 | 5/2003 | Douglass et al. | |
| 6,585,531 | B1 | 7/2003 | Stepniak et al. | |
| 6,664,478 | B2 | 12/2003 | Mohan et al. | |
| 6,674,159 | B1 | 1/2004 | Peterson et al. | |
| 6,689,947 | B2 | 2/2004 | Ludwig | |
| 6,705,898 | B2 | 3/2004 | Pechstein et al. | |
| 6,709,294 | B1 | 3/2004 | Cohen et al. | |
| 6,733,322 | B2 | 5/2004 | Boemmel et al. | |
| 6,744,255 | B1 | 6/2004 | Steinbrecher et al. | |
| 6,790,063 | B2 | 9/2004 | Jazowski et al. | |
| 6,796,820 | B2 | 9/2004 | Jazowski et al. | |
| 6,809,413 | B1 | 10/2004 | Peterson et al. | |
| 6,811,418 | B2 | 11/2004 | Jazowski et al. | |
| 6,830,475 | B2 | 12/2004 | Jazowski et al. | |
| 6,843,685 | B1 | 1/2005 | Borgstrom et al. | |
| 6,888,086 | B2 | 5/2005 | Daharsh et al. | |
| 6,905,356 | B2 | 6/2005 | Jazowski et al. | |
| 6,936,947 | B1 | 8/2005 | Leijon et al. | |
| 6,939,151 | B2 | 9/2005 | Borgstrom et al. | |
| 6,972,378 | B2 | 12/2005 | Schomer et al. | |
| 6,984,791 | B1 | 1/2006 | Meyer et al. | |
| 7,018,236 | B2 | 3/2006 | Nishio et al. | |
| 7,019,606 | B2 | 3/2006 | Williams et al. | |
| 7,044,760 | B2 | 5/2006 | Borgstrom et al. | |
| 7,044,769 | B2 | 5/2006 | Zhao et al. | |
| 7,050,278 | B2 | 5/2006 | Poulsen | |
| 7,059,879 | B2 | 6/2006 | Krause et al. | |
| 7,077,672 | B2 | 7/2006 | Krause et al. | |
| 7,079,367 | B1 | 7/2006 | Liljestrand | |
| 7,083,450 | B1 | 8/2006 | Hughes | |
| 7,104,822 | B2 | 9/2006 | Jazowski et al. | |
| 7,104,823 | B2 * | 9/2006 | Jazowski et al. | 439/181 |
| 7,108,568 | B2 | 9/2006 | Jazowski et al. | |
| 7,134,889 | B2 | 11/2006 | Hughes et al. | |
| 7,150,098 | B2 | 12/2006 | Borgstrom et al. | |
| 7,168,983 | B2 | 1/2007 | Graf et al. | |
| 7,170,004 | B2 | 1/2007 | Gramespacher et al. | |
| 7,182,647 | B2 | 2/2007 | Muench et al. | |
| 7,212,389 | B2 | 5/2007 | Hughes | |
| 7,216,426 | B2 * | 5/2007 | Borgstrom et al. | 29/883 |
| 7,234,980 | B2 | 6/2007 | Jazowski et al. | |
| 7,247,061 | B2 | 7/2007 | Hoxha et al. | |
| 7,247,266 | B2 | 7/2007 | Bolcar | |
| 7,258,585 | B2 | 8/2007 | Hughes et al. | |
| 7,278,889 | B2 | 10/2007 | Muench et al. | |
| 7,341,468 | B2 | 3/2008 | Hughes et al. | |
| 2001/0008810 | A1 | 7/2001 | George et al. | |
| 2002/0055290 | A1 | 5/2002 | Jazowski et al. | |
| 2003/0228779 | A1 | 12/2003 | Jazowski et al. | |
| 2004/0121657 | A1 | 6/2004 | Muench et al. | |
| 2005/0208808 | A1 | 9/2005 | Jazowski et al. | |
| 2005/0212629 | A1 | 9/2005 | William et al. | |
| 2005/0260876 | A1 | 11/2005 | Krause et al. | |
| 2006/0110983 | A1 | 5/2006 | Muench et al. | |
| 2006/0160388 | A1 | 7/2006 | Hughes et al. | |
| 2006/0216992 | A1 | 9/2006 | Hughes et al. | |
| 2007/0026713 | A1 | 2/2007 | Hughes et al. | |
| 2007/0026714 | A1 | 2/2007 | Hughes et al. | |
| 2007/0032110 | A1 | 2/2007 | Hughes et al. | |
| 2007/0108164 | A1 | 5/2007 | Muench et al. | |

FOREIGN PATENT DOCUMENTS

| | | | |
|---|---|---|---|
| DE | 3521365 | | 2/1987 |
| DE | 19906972 | A1 | 2/1999 |
| EP | 0624940 | | 11/1994 |
| EP | 0782162 | A2 | 7/1997 |
| EP | 0957496 | | 11/1999 |
| FR | 2508729 | | 12/1982 |
| GB | 105227 | | 2/1918 |
| GB | 2254493 | | 10/1992 |
| JP | S62-198677 | | 12/1987 |
| JP | S63-93081 | | 6/1988 |
| JP | H1-175181 | | 7/1989 |
| JP | H3-88279 | | 9/1991 |
| JP | H4-54164 | | 5/1992 |
| WO | WO 00/41199 | | 7/2000 |

OTHER PUBLICATIONS

Loadbreak Apparatus Connectors Service Information 500-26, Cooper Power Systems, May 2003, Waukesha, WI.

Deadbreak Apparatus Connectors Electrical Apparatus, Cooper Power Systems, Jul. 1999, Marketing Material.

Link-Op 600A Operable Connector System, Marketing Material, date not available.

Installation Instructions, 650LK-B Link Operable Connector System (Bolted) May 1, 1989.

G&W Electric Co.; "Breakthrough in Switching Technology; Solid Dielectric Switchgear"; Oct. 2001; Blue Island, IL. cited by other .

Cooper Power Systems; "Padmounted Switchgear; Type RVAC, Vacuum-Break Switch, Oil-Insulated or SF.sub.6-Insulated; Electrical Apparatus 285-50"; Jul. 1998. cited by other .

Cooper Power Systems; "Padmounted Switchgear; Type MOST Oil Switch; Electrical Apparatus 285-20"; Jul. 1998. cited by other .

Cooper Power Systems; "Molded Rubber Products; 600 A 35 kV Class Bol-T.TM. Deadbreak Connector; Electrical Apparatus 600-50"; Jan. 1990. cited by other.

Cooper Power Systems; "Padmounted Switchgear; Kyle.RTM. Type VFI Vacuum Fault Interrupter; Electrical Apparatus 285-10", Jan. 1998. cited by other .

"Loadbreak Appatus Connectors, 200 A 25kV Class—Expanded Range Loadbreak Elbow Connector, Electrical Apparatus 500-28"; Cooper Power Systems; pp. 1-4; (Jan. 2004). cited by other .

Kevin Fox, "The Cooper Posi-Break.TM. Solution to Separable Connector Switching Problems at Wisconsin Electric Power Company,"Component Products, Bulletin No. 98065, copyright 1998 Cooper Power Systems, MI 10-98 5M, 2 total pages. cited by other .

"The Cooper Posi-Break.TM., Elbow and Cap, Engineered Solution Increases Strike Distance and Improves Reliability," copyright 1998 Cooper Power Systems, Inc., Bulletin 98014, MI 398/15M, 6 total pages. cited by other.

Loadbreak Apparatus Connectors, "200 A 25 kV Class Loadbreak Bushing Insert," Service Information 500-26, Cooper Power Systems, May 2003, pp. 1-2. cited by other .

Loadbreak Apparatus Connectors, "200 A kV Class Cooper Posi-Break.TM. Expanded Range Loadbreak Elbow Connector," Service Information 500-29, Cooper Power Systems, Jan. 2004, pp. 1-4. cited by other .

Product Brief, "Latched Elbow Indicator," Cooper Power Systems, Bulletin 94014, Apr. 1994, 1 total page. cited by other .

"Stick-OPerable 600-Amp Connector Systems," *Elastimold, Amerace Corporation*, Feb. 1984, 11 pages.

"Molded Rubber Products, 600 A 15 kV Class T-OP™ II Deadbreak Connector Electrical Apparatus 600-12," *Cooper Power Systems*, Jul. 2005, pp. 1-4.

"Molded Rubber Products, 600 A 15 and 25 kV Deadbreak Accessories, Tools, Replacement Parts Electrical Apparatus 600-46"; *Cooper Power Systems*, Jul. 1997, pp. 1-4.

"Molded Rubber Products, 600 A 25 kV Class BT-TAP™ Deadbreak Connector Electrical Apparatus, 600-35," *Cooper Power Systems*, Mar. 2003, pp. 1-5.

"Deadbreak Apparatus Connectors, 600 A 15/25 kV Class Bol-T™ Deadbreak Connector Electrical Apparatus 600-10," *Cooper Power Systems*, Aug. 2002, 6 pages.

"Deadbreak Apparatus Connector, 600 A 25 kV Class Bushing Adapter for T-OP™ II Connector Systems (including LRTP and Bushing Extender) Electrical Apparatus 600-38," *Cooper Power Systems*, Jun. 1997, pp. 1-4.

"Loadbreak Apparatus Connectors, 200 A 15 kV Class Loadbreak Bushing Insert 500-12," *Cooper Power Systems*, Nov. 1995, pp. 1-2.

"T-OP™ II: How Many Sticks Does It Take To Operate Your 600 Amp Terminator System?," *Cooper Power Systems*, Jul. 1994, 4 pages.

"Installation & Operation Instructions 168ALR, Access Port Loadbreak Elbow Connectors"; *Elastimold IS-168ALR* (*Rev C*); pp. 1-5; (Feb. 1, 1994).
"Operating Instructions 200TC-2"; *Elastimold IS-200TC* (*Rev-A*); pp. 1-2; (Feb. 26, 1995).
"Surge Arresters"; *Elastimold Catalog*; pp. 26-27; (2001).
"Surge Arresters, Metal Oxide Varistor elbow (M.O.V.E.™) Surge Arrester Electrical Apparatus 235-65"; *Cooper Power Systems*; pp. 1-4; Dec. 2003.
"Surge Arresters, Metal Oxide Elbow Surge Arrester Electrical Apparatus 235-65"; *Cooper Power Systems*; pp. 1-4; Jan. 1991.
"Surge Arresters, Metal Oxide Varistor (MOV) Parking Stand Surge Arrester Electrical Apparatus 235-68"; *Cooper Power Systems*; pp. 1-3; Apr. 2002.
"INJPLUG35, 35 kV Amp Loadbreak Injection Plug Operating and Installation Instructions"; *Cooper Power Systems*; p. 1; (Sep. 2002).
"Loadbreak Apparatus Connectors, 200 A 15 kV Class Loadbreak Elbow Connector, Electrical Apparatus 500-10"; *Cooper Power Systems*; pp. 1-4; (Feb. 2004).
"Loadbreak Apparatus Connectors, 200 A 15 kV and 25 kV Class Elbow Installation Instructions, Service Information S500-10-1"; *Cooper Power Systems*; pp. 1-4; (Feb. 2001).
"Loadbreak Apparatus Connectors, 200 A 15kV Class Loadbreak Bushing Insert 500-12"; *Cooper Power Systems*; pp. 1-2; (Nov. 1995).
"Loadbreak Apparatus Connectors, 200 A 15kV Class Loadbreak Rotatable Feedthru Insert; Electrical Apparatus 500-13"; *Cooper Power Systems*; pp. 1-2; (Apr. 2001).
"Loadbreak Apparatus Connectors, 200 A 25 kV Class—Expanded Range Loadbreak Elbow Connector, Electrical Apparatus 500-28"; *Cooper Power Systems*; pp. 1-4; (Jan. 2004).
"Loadbreak Apparatus Connectors, 200 A 25 kV Class Rotatable Feedthru Insert, Electrical Apparatus 500-30"; *Cooper Power Systems*; pp. 1-2; (Jun. 1999).
"Loadbreak Apparatus Connectors, 200 A 35 kV Class Three-Phase Loadbreak Injection Elbow Installation Instructions, Service Information S500-55-2"; *Cooper Power Systems*; pp. 1-6; (Apr. 1999).
Cooper Power Systems, *Deadbreak Apparatus Connectors*, "600 A 15/25 kV Clas Bol-T™ Deadbreak Connector", Electrical Apparatus 600-30, pp. 1-6, Feb. 2003.
Cooper Power Systems, *Deadbreak Apparatus Connectors*, "600 A 15/25 kV Class PUSH-OP® Deadbreak Connector", Electrical Apparatus 600-33, pp. 1-4, Nov. 2004.
Cooper Power systems, *Molded Rubber Products*, "600 A 15/25 kV Class T-OP™ II Deadbreak Connector", Electrical Apparatus 600-32, pp. 1-4, Jul. 2005.
Cooper Power Systems, *OEM Equipment*, "Four-Position Sectionalizing Loadbreak Switches", Electrical Apparatus 800-64, pp. 1-8, Dec. 2003.

* cited by examiner

THERMOPLASTIC INTERFACE AND SHIELD ASSEMBLY FOR SEPARABLE INSULATED CONNECTOR SYSTEM

BACKGROUND OF THE INVENTION

The invention relates generally to cable connectors for electric power systems, and more particularly to separable insulated connector systems for use with medium voltage cable distribution systems.

Electrical power is typically transmitted from substations through cables which interconnect other cables and electrical apparatus in a power distribution network. The cables are typically terminated on bushings that may pass through walls of metal encased equipment such as capacitors, transformers or switchgear. Such cables and equipment transmit electrical power at medium and high voltages generally greater than 600V.

Separable connector systems have been developed that allow ready connection and disconnection of the cables to and from the electrical equipment. In general, two basic types of separable connector systems have conventionally been provided, namely deadbreak connector systems and loadbreak connector systems. Conventional connectors of this type are disadvantaged in certain aspects and improvements are desired.

DETAILED DESCRIPTION OF THE INVENTION

Embodiments of separable insulated connector systems are disclosed herein that provide improvements over conventional connector systems and avoid certain problems associated therewith. In order to understand the invention to its fullest extent, the following disclosure will be segmented into different parts or sections, wherein Part I discusses conventional separable systems and disadvantages thereof, and Part II discusses separable connector systems of the invention.

I. Introduction to the Invention

Figure 1:
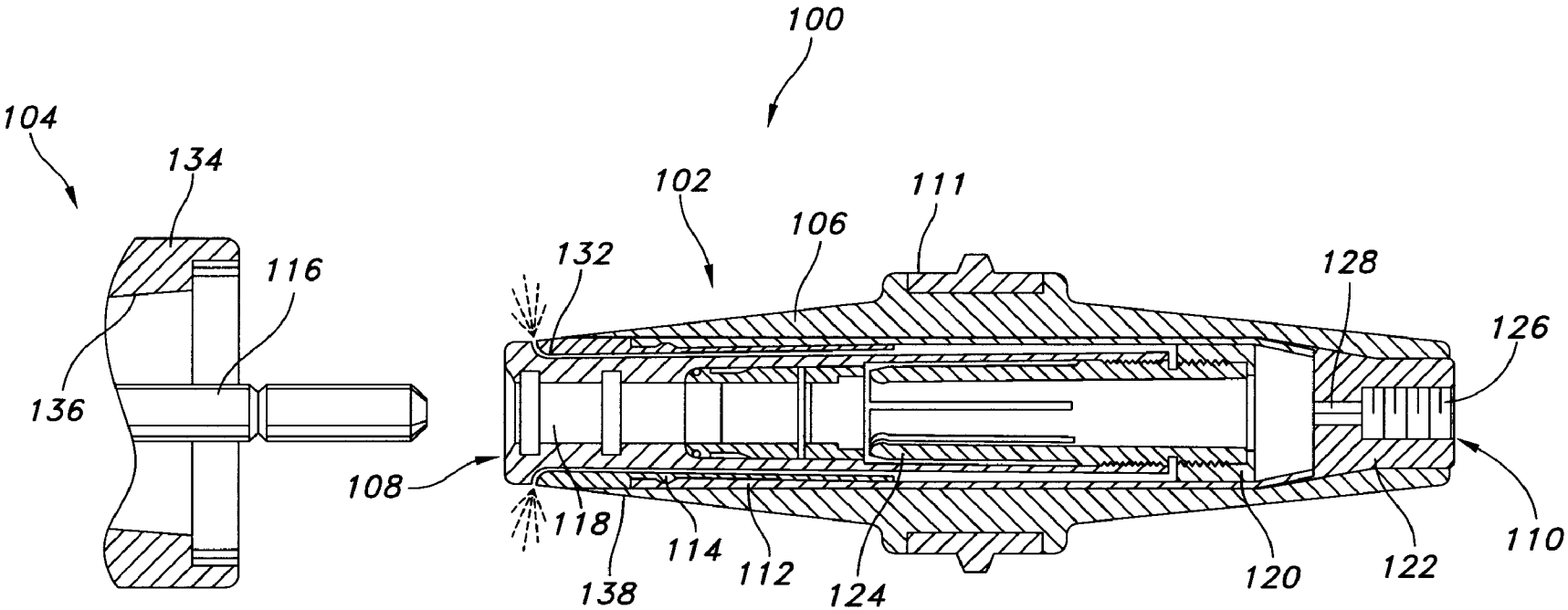
FIG. 1 PRIOR ART
FIG. 1 is a cross sectional view of a known separable insulated connector system including a bushing and a connector.

FIG. 1 is a cross sectional view of a known separable insulated connector system 100 including a bushing 102 and a connector 104. The connector 104 may be configured, for example, as an elbow connector that may be mechanically and electrically connected to a power distribution cable on one end and is matable with the bushing 102 on the other end. Other configurations of the connector 104 are possible, including "T" connectors and other connector shapes known in the art.

The bushing 102 includes an insulated housing 106 having an axial bore therethrough providing a hollow center to the housing 106. The housing 106 may be fabricated from elastomeric insulation such as an EPDM rubber material in one embodiment, although other materials may be utilized. The housing 106 has a first end 108 and a second end 110 opposing one another, wherein the first end 108 is open and provides access to the axial bore for mating the connector 104. The second end 110 is adapted for connection to a conductive stud of a piece of electrical equipment such as a power distribution transformer, capacitor or switchgear apparatus, or to bus bars and the like associated with such electrical equipment.

A middle portion or middle section of the housing 106 is cylindrically larger than the first and second ends 108 and 110. The middle section of the housing 106 may be provided with a semi-conductive material that provides a deadfront safety shield 111. A rigid internal shield housing 112, fabricated from a conductive metal, may extend proximate to the inner wall of the insulated housing 106 defining the bore. The shield housing 112 preferably extends from near both ends of insulated housing 106 to facilitate optimal electrical shielding in the bushing 102.

The bushing 102 also includes an insulative or nonconductive nosepiece 114 that provides insulative protection for the shield housing 112 from a ground plane or a contact probe 116 of the mating connector 104. The nosepiece 114 is fabricated from, for example, glass nylon or another insulative material, and is attached to the shield housing 112 with, for example, threaded engagement or snap-fit engagement. A contact tube 118 is also provided in the bushing 102 and is a generally cylindrical member dimensioned to receive the contact probe 116.

As illustrated in FIG. 1, the bushing 102 is configured as a loadbreak connector and the contact tube 118 is slidably movable from a first position to a second position relative to the housing 106. In the first position, the contact tube 118 is retracted within the bore of the insulated housing 106 and the contact element is therefore spaced from the end 108 of the connector. In the second position the contact tube 118 extends substantially beyond the end 108 of the insulated housing 106 for receiving an electrode probe 116 during a fault closure condition. The contact tube 118 accordingly is provided with an arc-ablative component, which produces an arc extinguishing gas in a known manner during loadbreak switching for enhanced switching performance.

The movement of the contact tube 118 from the first to the second position is assisted by a piston contact 120 that is affixed to contact tube 118. The piston contact 120 may be fabricated from copper or a copper alloy, for example, and may be provided with a knurled base and vents as is known in the art, providing an outlet for gases and conductive particles to escape which may be generated during loadbreak switching. The piston contact 120 also provides a reliable, multipoint current interchange to a contact holder 122, which typically is a copper component positioned adjacent to the shield housing 112 and the piston contact 120 for transferring current from piston contact 120 to a conductive stud of electrical equipment or bus system associated therewith. The contact holder 122 and the shield housing 112 may be integrally formed as a single unit as shown in FIG. 1. The contact tube 118 will typically be in its retracted position during continuous operation of the bushing 102. During a fault closure, the piston contact 120 slidably moves the contact tube 118 to an extended position where it can mate with the contact probe 116, thus reducing the likelihood of a flashover.

A plurality of finger contacts 124 are threaded into the base of the piston contact 120 and provide a current path between the contact probe 116 and the contact holder 122. As the connector 104 is mated with the bushing 102, the contact probe 116 passes through the contact tube 118 and mechanically and electrically engages the finger contacts 124 for continuous current flow. The finger contacts 124 provide multi-point current transfer to the contact probe 116, and from the finger contacts 124 to a conductive stud of the electrical equipment associated with the bushing 102.

The bushing 102 includes a threaded base 126 for connection to the conductive stud. The threaded base 126 is positioned near the extremity of the second end 110 of the insulated housing 106, adjacent to a hex broach 128. The hex broach 128 is preferably a six-sided aperture, which assists in the installation of a bushing 102 onto a conductive stud with a torque tool. The hex broach 128 is advantageous because it allows the bushing 102 to be tightened to a desired torque.

A contoured venting path 132 is also provided in the bushing 102 to divert the flow of gases and particles away from the contact probe 116 of the connector 104 during loadbreak switching. As shown in FIG. 1, the venting path 132 redirects the flow of gases and conductive particles away from the mating contact probe 116 and away from an axis of the bushing 102, which is coincident with the axis of motion of the contact probe 116 relative to the bushing 102.

The venting path 132 is designed such that the gases and conductive particles exit the hollow area of the contact tube 118 and travel between an outer surface of the contact tube 118 and inner surfaces of the shield housing 112 and nosepiece 114 to escape from the first end 108 of the insulated housing 106. Gases and conductive particles exit the venting path 132 and are redirected away from contact probe 116 for enhanced switching performance and reduced likelihood of a re-strike.

The connector 104 also includes an elastomeric housing defining an interface 136 on an inner surface thereof that accepts the first end 108 of the bushing 102. As the connectors 102 and 104 are mated, the elastomeric interface 136 of the connector 104 engages an outer connector engagement surface or interface 138 of the insulating housing 106 of the bushing 104. The interfaces 136, 138 engage one another with a slight interference fit to adequately seal the electrical connection of the bushing 102 and the connector 104. The elastomeric materials of the housings 134 and 106, which may each include EPDM rubber, for example, results in a rather high frictional force between the mating interfaces 136 and 138 in use. Large forces may be required to overcome frictional forces developed between the connector interfaces 136 and 138, rendering the connectors 102 and 104 difficult to mate to one another. The rubber-to-rubber interfaces 136, 138 of the connectors 102 and 104 tend to stick together even when lubricated. It would be desirable to provide separable connectors that may be operated or mated with reduced insertion force to overcome resistance of the connector interfaces.

Additionally, from a manufacturing perspective the construction of the bushing 102 is less than ideal. A number of separately fabricated component parts are assembled prior to molding the housing 106, including the shield housing 112, the hex broach 128, and the nosepiece 114. The component assembly is placed in a mold, together with the semiconductive shield 111 and an optional, separately fabricated latch ring indicator (not shown in FIG. 1). The insulating housing 106 is typically injection molded around and between the components in the housing at high pressure. Undesirable formation of air gaps in the housing tends to be difficult to control, and rubber leakage into the contact assembly is of particular concern.

Any air gaps that may be present between connector components may also result in corona discharge and electrical failure of the connector. For example, threaded mechanical connections or snap-fit connections, such as between the nosepiece 114 and the shield housing 112, tend to result in undesirable air gaps in and around the threads or snap-fit connections and at the end of the shield housing 112 that may result in corona discharge and electrical failure conditions at the end of the shield housing 112. Also, sharp edges of threads or interfering snap-fit geometry features on the inner diameter of the shield housing 112 are points of high electrical stress that can alter electric fields during loadbreak switching operation, potentially causing electrical failure and safety hazards. Thus, even if air gaps between the shield housing 112 and the housing 106 are eliminated, electrical failure may still result via air gaps proximate the connection of the shield housing 112 and the nosepiece 114. Elimination of such air gaps and shield housing geometries that result in high electrical stress would be beneficial.

Additionally, to prevent the elastomeric insulating material used to form the housing material 106 from sticking to the mold as the bushing 102 is produced, chemical release agents are typically utilized in the mold. It would be desirable to avoid such chemical release agents due to environmental concerns that such chemicals may present.

Still further, the molding processes typically used to manufacture the housing 106 requires mold flashing to be trimmed from the molded parts, adding a manufacturing step and cost to the manufacture of the bushing 102. Mold parting lines may compromise the insulation and dielectric properties of the housing 106 and may result in undesirable electrical short circuit conditions. Also, contaminants in the molding processes may undesirably affect the dielectric performance of the bushing 102.

U.S. Pat. No. 7,044,760 proposes methods for manufacturing separable connectors of the type described above, wherein a pre-molded interface shell fabricated from material different from the insulating housing and having a lower coefficient of friction is utilized to reduce frictional forces in the connector interface. As described in the '760 patent, the rubber insulating housing is bonded to the pre-molded interface shell in a molding operation to simplify the manufacture of the connector and avoid excess flashing and mold parting lines, and to isolate the molding material from the mold surfaces. This solution, however, is not entirely satisfactory from a manufacturing perspective.

II. Exemplary Embodiments of the Invention

Exemplary embodiments of medium voltage separable connectors are disclosed herein having a fewer number of component parts and that are believed to be manufacturable at lower cost and with less difficulty than known insulated separable connectors.

Figure 2:
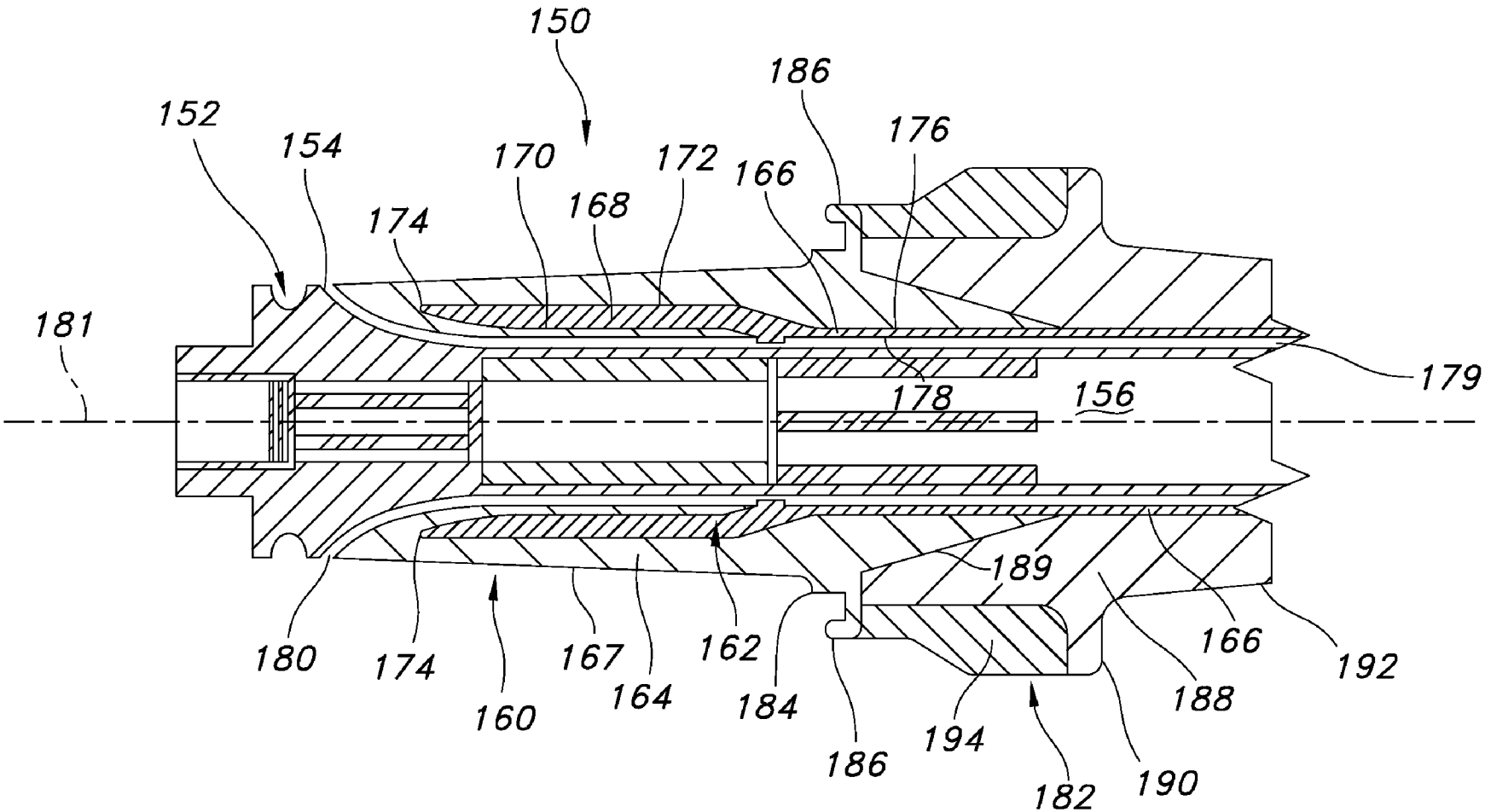
FIG. 2 is a cross sectional view of a first embodiment of a bushing formed in accordance with an exemplary embodiment of the invention.

FIG. 2 is a cross sectional view of a first embodiment of a connector bushing 150 formed in accordance with an exemplary embodiment of the invention. The bushing 150 may be used in lieu of the bushing connector 102 shown in FIG. 1 in the connector system 100. The bushing 150 is configured as a loadbreak connector, and accordingly includes a loadbreak contact assembly 152 including a contact tube 154, a piston contact element 156 having finger contacts that is movable within the contact tube in a fault closure condition and an arc-ablative component which produces an arc extinguishing gas in a known manner during loadbreak switching for enhanced switching performance. A hex broach 158 is also provided and may be used to tighten the connector bushing 150 to a stud terminal of a piece of electrical equipment.

Unlike the embodiment of FIG. 1, the bushing connector 150 includes a shield assembly 160 surrounding the contact assembly 152 that provides numerous benefits to users and manufacturers alike. The shield assembly 160 may include a conductive shield in the form of a shield housing 162, and an insulative or nonconductive housing interface member 164 formed on a surface of the shield housing 162 as explained below. The interface member 164 may be fabricated from a material having a low coefficient of friction relative to conventional elastomeric materials such as EPDM rubber for example. Exemplary materials having such a low coefficient of friction include polytetrafluroethylene, thermoplastic elastomer, thermoplastic rubber and other equivalent materials known in the art. The housing interface member 164 is generally conical in outer dimension or profile so as to be received in, for example, the connector interface 136 of the connector 104 shown in FIG. 1.

The low coefficient of friction material used to fabricate the housing interface member 164 provides a smooth and generally low friction connector engagement surface 167 on outer portions of the interface member 164 that when engaged with the connector interface 136 (FIG. 1), which as mentioned above may be fabricated from elastomeric insulation such as EPDM rubber, enables mating of the connectors with much less insertion force than known connector systems involving rubber-to-rubber surface engagement as the connectors are mated.

As shown in FIG. 2, the shield housing 162 may be a generally cylindrical element fabricated from a conductive material and having at least two distinct portions of different internal and external diameter. That is, the shield housing 162 may be formed and fabricated with a first portion 166 having a first generally constant diameter surrounding the contact element 156 and a second portion 168 having a larger diameter than the first diameter. As such, the second portion 168 is outwardly flared in the second portion 168 in comparison to the first portion 166. The second portion 168 defines a leading end of the shield housing 162, and is encased or encapsulated in the material of the interface member 164. That is, the low coefficient of friction material forming the interface member 164 encloses and overlies both an inner surface 170 of the housing shield leading end 168 and an outer surface 172 of the housing shield leading end 168. Additionally, a distal end 174 of the housing shield leading end 168 is substantially encased or encapsulated in the interface member 164. That is, the interface member 164 extends beyond the distal end 174 for a specified distance to provided a dielectric barrier around the distal end 174.

Such encasement or encapsulation of the housing shield leading end 168 with the insulative material of the interface member 164 fully insulates the shield housing leading end 168 internally and externally. The internal insulation, or the portion of the interface member 164 extending interior to the shield housing leading end 168 that abuts the leading end inner surface 170, eliminates any need to insulate a portion of the interior of the shield housing 162 with a separately fabricated component such as the nosepiece 114 shown in FIG. 1. Elimination of the separately provided nosepiece reduces a part count necessary to manufacture the connector bushing 150, and also reduces mechanical and electrical stress associated with attachment of a separately provided nosepiece via threads and the like. Still further, elimination of a separately provided nosepiece avoids present reliability issues and/or human error associated with incompletely or improperly connecting the nosepiece during initially assembly, as well as in subsequent installation, maintenance, and service procedures in the field. Elimination of a separately provided nosepiece also eliminates air gaps that may result between the nosepiece and the shield housing in threaded connections and the like that present possibilities of corona discharge in use.

Unlike the leading end 168 of the shield housing 162, the first portion 166 of the shield housing 162 is provided with the material of the interface member 164 only on the outer surface 176 in the exemplary embodiment of FIG. 2. That is, an inner surface 178 of the first portion of the shield housing 162 is not provided with the material of the interface member 164. Rather, a vent path 179 or clearance may be provided between the inner surface 178 of the shield housing 162 and the contact assembly 152. At the leading end of the connector 150, the vent path 179 may include a directional bend 180 to dispel gases generated in operation of the connector 150 away from an insertion axis 181 along which the connector 150 is to be mated with a mating connector, such as the connector 104 shown in FIG. 1.

Figure 3:
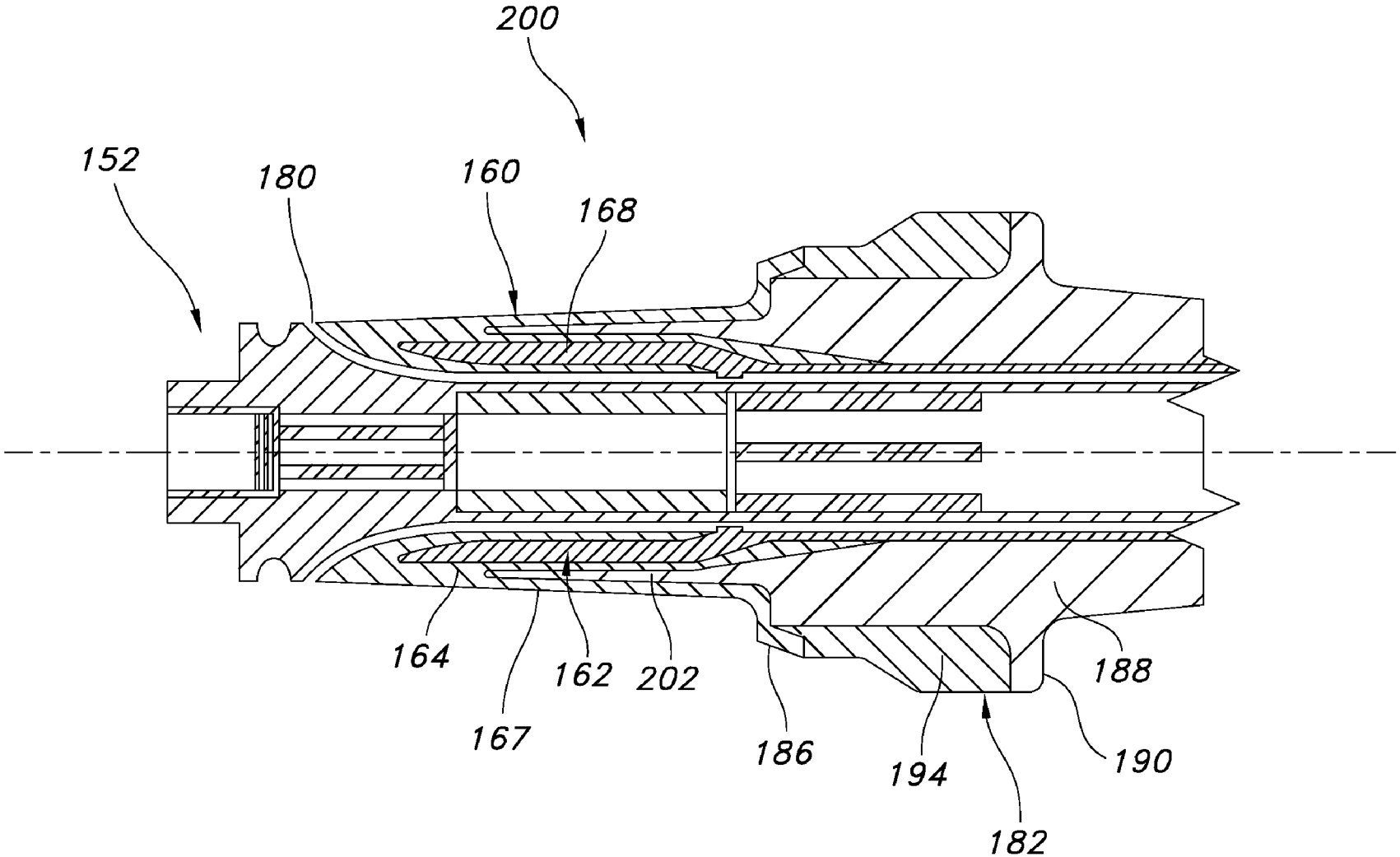
FIG. 3 is a cross sectional view of a second embodiment of a bushing formed in accordance with an exemplary embodiment of the invention.

The interface member 164 in an illustrative embodiment extends from the distal end, sometimes referred to as the leading end that is illustrated at the left hand side in FIG. 3, to a middle section or middle portion 182 of the connector 150 that has an enlarged diameter relative to the remaining portions of the connector 150. A transition shoulder 184 may be formed into the interface member 164 at the leading end of the middle portion 182, and a latch indicator 186 may be integrally formed into the interface member 164. With integral formation of the latch indicator, separately provided latch indicator rings and other known indicating elements may be avoided, further reducing the component part count for the manufacture of the connector 150 and eliminating process steps associated with separately fabricated latch indicator rings or indication components.

In an exemplary embodiment, and as shown in FIG. 2, the latch indicator 186 is positioned proximate the shoulder 184 so that when the connector 150 is mated with the mating connector 104 (FIG. 1) the latch indicator 186 is generally visible on the exterior surface of the middle section 182 when the connectors are not fully engaged. To the contrary, the latch indicator 186 is generally not visible on the exterior surface of the middle section 182 when the connectors are fully engaged. Thus, via simple visual inspection of the middle section 182 of the connector 150, a technician or lineman may determine whether the connectors are properly engaged. The latch indicator 186 may be colored with a contrasting color than either or both of the connectors 150 and 104 to facilitate ready identification of the connectors as latched or unlatched.

The connector middle section 182, as also shown in FIG. 2, may be defined by a combination of the interface member 164 and another insulating material 188 that is different from the material used to fabricate the interface member 164. The insulation 188 may be elastomeric EPDM rubber in one example, or in another example other insulation materials may be utilized. The insulation 188 is formed into a wedge shape in the connector middle section 182, and the insulation 188 generally meets the interface member 164 along a substantially straight line 189 that extends obliquely to the connector insertion axis 181. A transition shoulder 190 may be formed in the insulation 188 opposite the transition shoulder 184 of the interface member 164, and a generally conical bushing surface 192 may be formed by the insulation 188 extending away from the connector middle section 182. A deadfront safety shield 194 may be provided on outer surface of the insulation 188 in the connector middle section 182, and the safety shield 194 may be fabricated from, for example, conductive EPDM rubber or another conductive material.

The connector 150 may be manufactured, for example, by overmolding the shield housing 162 with thermoplastic material to form the interface member 164 on the surfaces of the shield housing 162 in a known manner. Overmolding of the shield housing is an effective way to encase or encapsulate the shield housing leading end 168 with the thermoplastic insulation and form the other features of the interface member 164 described above in an integral or unitary construction that renders separately provided nosepiece components and/or latch indicator rings and the like unnecessary. The shield housing 162 may be overmolded with or without adhesives using, for example, commercially available insulation materials fabricated from, in whole or part, materials such as polytetrafluroethylene, thermoplastic elastomers, thermoplastic rubbers and like materials that provide low coefficients of friction in the end product. Overmolding of the shield housing 162 provides an intimate, surface-to-surface, chemical bond between the shield housing 162 and the interface member 164 without air gaps therebetween that may result in corona discharge and failure. Full chemical bonding of the interface member 164 to the shield housing 162 on each of the interior and exterior of the shield housing 162 eliminates air gaps internal and external to the shield housing 162 proximate the leading end of the shield housing.

Once the shield housing 162 is overmolded with the thermoplastic material to form the interface member 164, the overmolded shield housing may be placed in a rubber press or rubber mold wherein the elastomeric insulation 188 and the shield 194 may be applied to the connector 150. The overmolded shield housing and integral interface member provides a complete barrier without any air gaps around the contact assembly 152, ensuring that no rubber leaks may occur that may detrimentally affect the contact assembly, and also avoiding corona discharge in any air gap proximate the shield housing 162 that may result in electrical failure of the connector 150. Also, because no elastomeric insulation is used between the leading end of the connector and the connector middle section 182, potential air entrapment and voids in the connector interface is entirely avoided, and so are mold parting lines, mold flashings, and other concerns noted above that may impede dielectric performance of the connector 150 as it is mated with another connector, such as the connector 104 (FIG. 1).

While overmolding is one way to achieve a full surface-to-surface bond between the shield housing 162 and the interface member 164 without air gaps, it is contemplated that a voidless bond without air gaps could alternatively be formed in another manner, including but not limited to other chemical bonding methods and processes aside from overmolding, mechanical interfaces via pressure fit assembly techniques and with collapsible sleeves and the like, and other manufacturing, formation and assembly techniques as known in the art.

An additional manufacturing benefit lies in that the thermoplastic insulation used to fabricate the interface member 164 is considerably more rigid than conventional elastomeric insulation used to construct such connectors in recent times. The rigidity of the thermoplastic material therefore provides structural strength that permits a reduction in the necessary structural strength of the shield housing 162. That is, because of increased strength of the thermoplastic insulation, the shield housing may be fabricated with a reduced thickness of metal, for example. The shield housing 162 may also be fabricated from conductive plastics and the like because of the increased structural strength of the thermoplastic insulation. A reduction in the amount of conductive material, and the ability to use different types of conductive material for the shield housing, may provide substantial cost savings in materials used to construct the connector.

FIGS. 3-6 illustrate alternative embodiments of bushing connectors that are similar to the connector 150 in many aspects and provide similar advantages and benefits. Like reference numbers of the connector 150 are therefore used in FIGS. 3-6 to indicate like components and features described in detail above in relation to FIG. 2.

FIG. 3 illustrates a bushing connector 200 wherein the interface member 164 is formed with a hollow void or pocket 202 between the housing shield leading end 168 and the connector engagement surface 167. The pocket 202 is filled with the insulation 188, while the thermoplastic insulation of the interface member encases the shield housing leading end 168 on its interior and exterior surfaces. The insulation 188 in the pocket 202 introduces the desirable dielectric properties of the elastomeric insulation 188 into the connector interface for improved dielectric performance.

Figure 4:
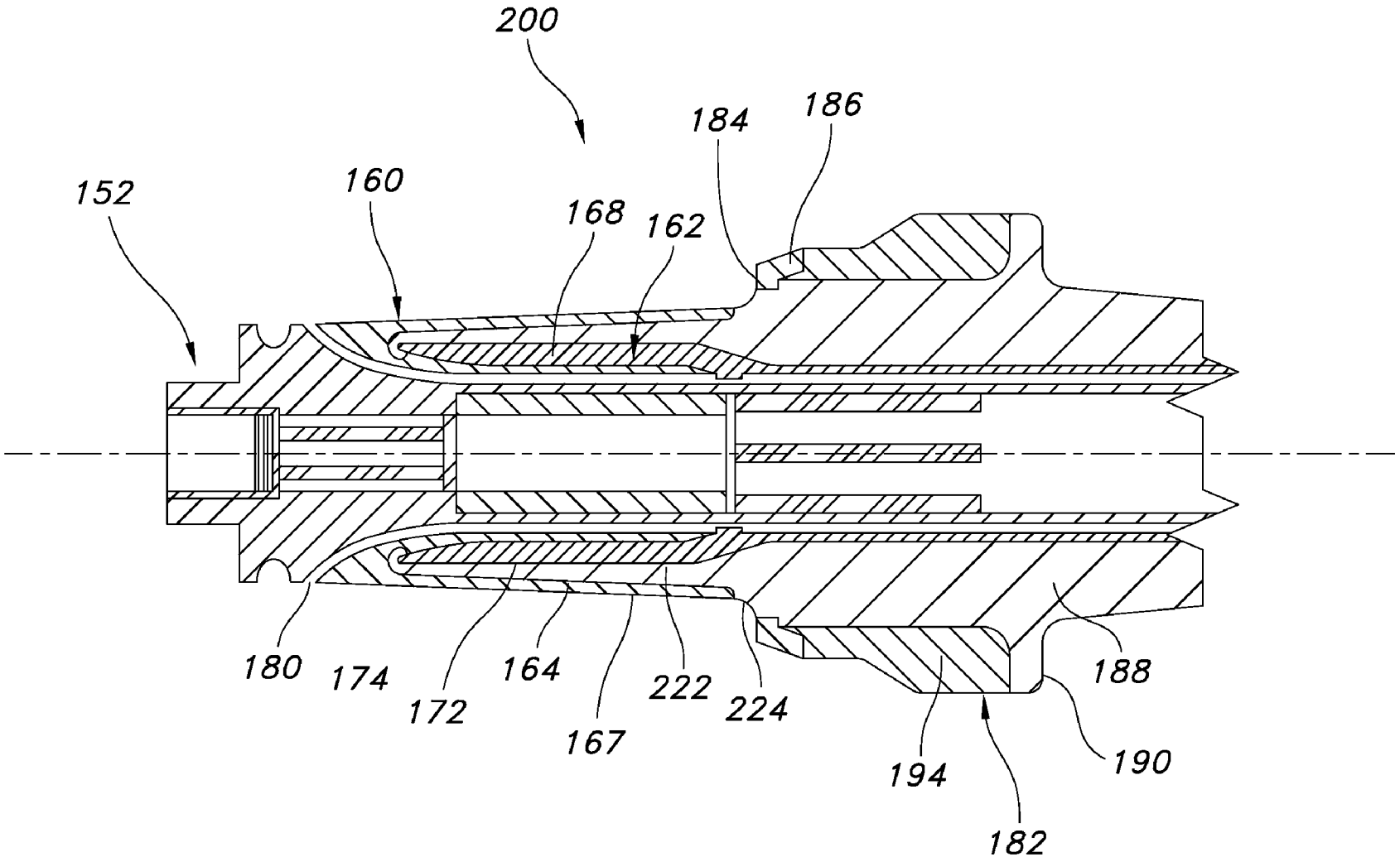
FIG. 4 is a cross sectional view of a third embodiment of a bushing formed in accordance with an exemplary embodiment of the invention.

FIG. 4 illustrates a bushing connector 220 similar to the connector 200 but having a larger pocket 222 formed in the interface member 164. Unlike the connectors 150 and 200, the thermoplastic insulation of the interface member 164 contacts only the inner surface 170 of the shield housing leading end 168, and the elastomeric insulation 188 abuts and overlies the outer surface 172 of the shield housing leading end 168. Dielectric performance of the connector 220 may be improved by virtue of the greater amount of elastomeric insulation 188 in the connector interface.

Also, as shown in FIG. 4, the transition shoulder 184 of the interface member 164 may include an opening 224 for venting purposes if desired.

Figure 5:
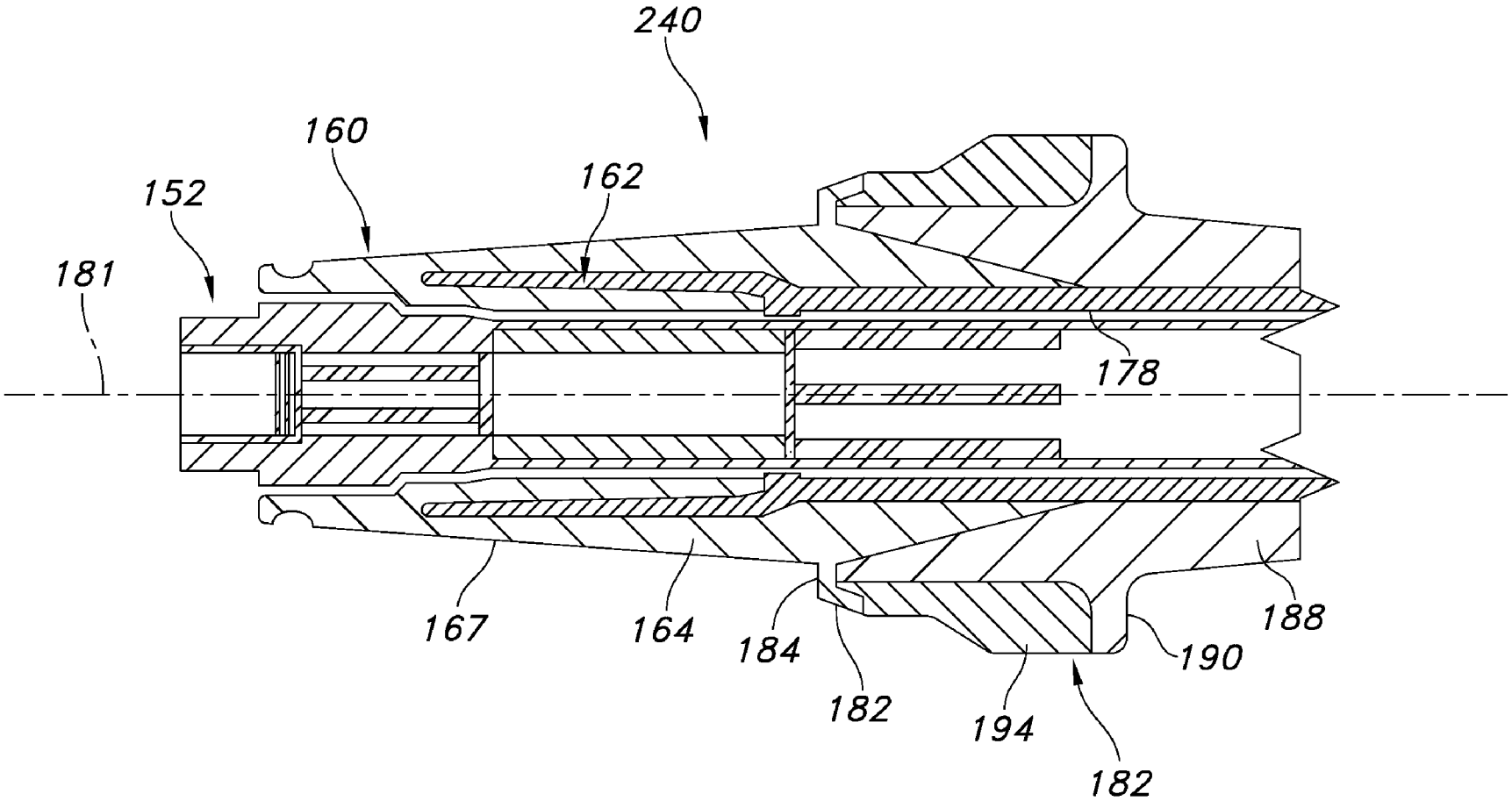
FIG. 5 is a cross sectional view of a fourth embodiment of a bushing formed in accordance with an exemplary embodiment of the invention.

FIG. 5 illustrates a bushing connector 240 like the connector 150 (FIG. 2) but illustrating a variation of the contact assembly 152 having a different configuration at the leading end, and the connector 250 has an accordingly different shape or profile of the interface member 164 at its leading end. Also, the directional vent 180 is not provided, and gases are expelled from the vent path 178 in a direction generally parallel to the insertion axis 181 of the connector 240.

Figure 6:
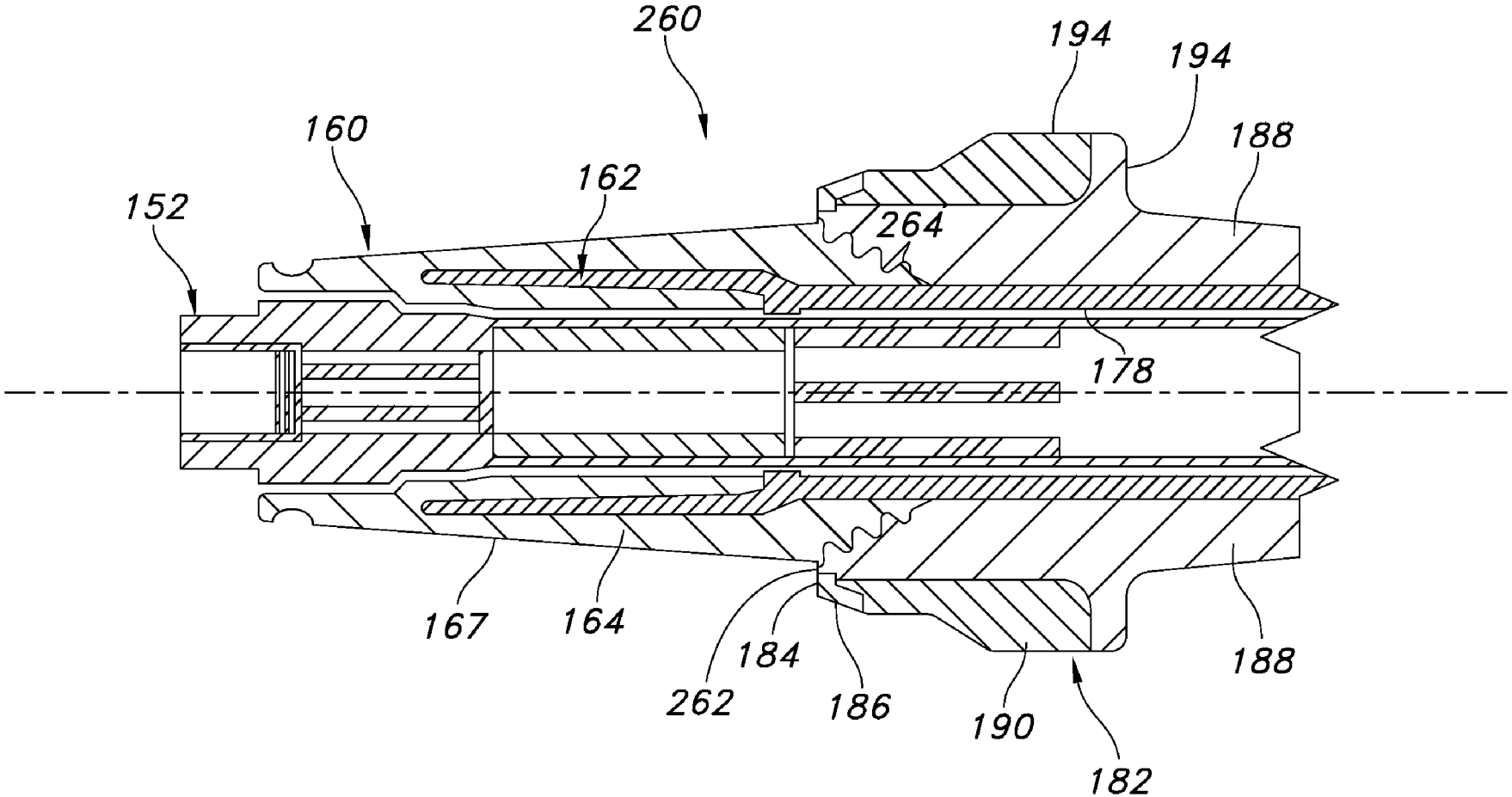
FIG. 6 is a cross sectional view of a fifth embodiment of a bushing formed in accordance with an exemplary embodiment of the invention.

FIG. 6 illustrates a bushing connector 260 like the connector 240 (FIG. 5) wherein the transition shoulder 184 of the interface member 164 includes an opening 262 for venting and the like, and wherein the interface member 164 includes a wavy, corrugated surface 264 in the middle section 182 where the interface member 164 meets the insulation 188. The corrugated surface 264 may provide a better bond between the two types of insulation, as opposed to the embodiment of FIG. 5 wherein the insulation materials meet in a straight line boundary.

Figure 7:
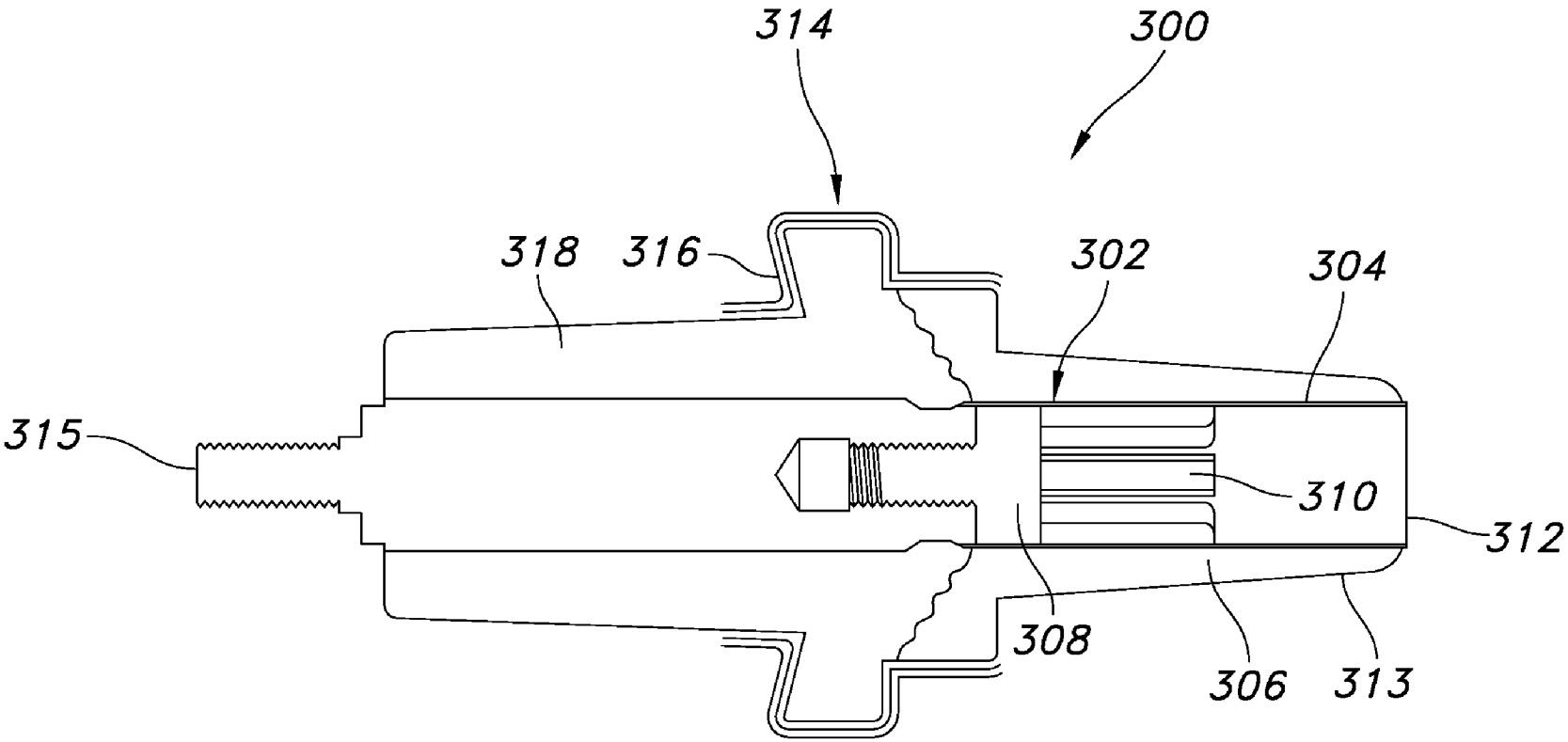
FIG. 7 is a cross sectional schematic view of a sixth embodiment of a bushing formed in accordance with an exemplary embodiment of the invention.

FIG. 7 is a cross sectional schematic view of a sixth embodiment of a bushing connector 300 that, unlike the foregoing embodiments of FIGS. 2-6 that are loadbreak connectors, is a deadbreak connector.

The bushing connector 300 may be used with a mating connector, such as the connector 102 shown in FIG. 1 in a deadbreak separable connector system. The bushing connector 300 includes a shield 302 in the form of a contact tube 304, and a contact element 308 having finger contacts 310. The contact element 308 is permanently fixed within the contact tube 304 in a spaced position from an open distal end 312 of the connector in all operating conditions. The shield 302 may be connected to a piece of electrical equipment via, for example, a terminal stud 315.

Like the foregoing embodiments, an insulative or nonconductive housing interface member 306 may be formed on a surface of the shield 302 in, for example, an overmolding operation as explained above. Also, as explained above, the interface member 306 may be fabricated from a material, such as the thermoplastic materials noted above, having a low coefficient of friction relative to conventional elastomeric materials such as EPDM rubber for example, therefore providing a low friction connector engagement surface 313 on an outer surface of the interface member 306.

The connector 300 may include a middle section 314 having an enlarged diameter, and a conductive ground plane 316 may be provided on the outer surface of the middle section 314. The middle section 314 may be defined in part by the interface member 306 and may in part be defined by elastomeric insulation 318 that may be applied to the overmolded shield 302 to complete the remainder of the connector 300. The connector 300 may be manufactured according to the basic methodology described above with similar manufacturing benefits and advantages to the embodiments described above.

The connector 300 in further and/or alternative embodiments may be provided with interface members having hollow voids or pockets as described above to introduce desirable dielectric properties of elastomeric insulation into the connector interface. Other features, some of which are described above, may also be incorporated into the connector 300 as desired.

III. Conclusion

The benefits and advantages of the invention are now believed to be amply demonstrated in the various embodiments disclosed.

One embodiment of a separable insulated connector is disclosed. The connector comprises: a conductive shield; a contact element situated within the shield; and an insulative housing interface member formed on the conductive shield, the housing interface member being fabricated from a thermoplastic material, and the interface member defining an engagement surface for sliding engagement with a mating connector.

Optionally, the engagement surface may be fabricated from a material having a low coefficient of friction. The interface member may be adapted to eliminate air gaps proximate the shield. The shield may include a first portion having a first diameter, and a second portion having a second diameter. A leading end of the shield may be encased in the housing interface member. The housing interface member may extend interior to at least a portion of the shield. The connector may comprise an insulated elastomeric housing, with a portion of the elastomeric housing in intimate contact with an exterior surface of the shield. The housing interface member may comprise an indicating portion formed integrally with the interface member. The connector may also comprise a middle section, the middle section provided with a semi-conductive shield on an outer surface thereof. A portion of the middle section may be occupied by the housing interface member and a portion of the middle section may be occupied by an elastomeric insulation. At least one vent may also be provided in the middle section.

Also optionally, the housing interface may comprise an inner surface, an outer surface, and a hollow portion between the inner surface and the outer surface, with the hollow portion filled with an elastomeric material. The interface housing member may comprise a corrugated surface. At least one directional vent may expel gases away from an insertion axis of the connector. The shield may be overmolded with the housing interface member. The shield may comprise one of a shield housing and a contact tube. The housing interface member may comprise one of polytetrafluroethylene, thermoplastic elastomer, thermoplastic rubber and the like. A contact tube may be situated within the shield and containing the contact element, with the contact tube being slidable relative to the interface member. The engagement surface may comprise a conical bushing interface.

Another embodiment of a separable insulated connector for a medium voltage cable system in a power distribution system is also disclosed. The connector comprises: a contact tube; and a conductive shield housing surrounding at least a portion of the contact tube; and an insulative housing interface member fabricated from a thermoplastic material, the interface member defining an outer engagement surface for sliding engagement with a mating connector, and an inner surface receiving a portion of the contact tube; and wherein the housing interface member extends interior to at least a portion of the shield housing.

Optionally, the leading end of the shield housing may be encased in the housing interface member. The interface member may eliminate air gaps proximate the shield. The connector may further comprise an insulated elastomeric housing, with a portion of the elastomeric housing in intimate contact with an exterior surface of the shield housing. The housing interface portion may comprise an indicating portion. The housing interface portion may also comprise an interface shoulder and an interface surface, with the indicating portion situated proximate the shoulder. The connector may comprise a middle section, with the middle section provided with a semiconductive shield on an outer surface thereof. A portion of the middle section may be occupied by the housing interface member and a portion of the middle section may be occupied by an elastomeric insulation. At least one vent may also be provided in the middle section.

Optionally, the housing interface may comprise an inner surface, an outer surface, and a hollow portion between the inner surface and the outer surface. At least one directional vent may extend between the housing interface member and the contact tube. The shield housing may be overmolded with the housing interface member. The thermoplastic interface may comprise one of polytetrafluroethylene, thermoplastic elastomer, thermoplastic rubber and the like. The connector may be a loadbreak connector. The outer engagement surface may comprise a conical bushing interface.

An embodiment of a separable insulated connector for a medium voltage cable system of a power distribution system, the connector matable to and separable from a mating connector to make or break an electrical connection therebetween is also disclosed. The mating connector has a contact probe, and the connector comprises: a contact tube comprising an open end for receiving the contact probe; a contact element in the contact tube and spaced from the open end; a conductive shield housing surrounding at least a portion of the contact tube; an insulative housing interface member fabricated from a thermoplastic material, the interface member defining an outer engagement surface having a low coefficient of friction for sliding engagement with a mating connector, and an inner surface receiving a portion of the contact tube; and wherein the shield housing is overmolded with the housing interface member and portion of the housing interface member insulates an inner surface of the conductive shield.

Optionally, the connector may be a loadbreak connector. The connector may comprise an elastomeric housing and a semiconductive shield. The interface may further comprise an integrally formed latch indicator.

Another embodiment of a separable insulated connector system for a medium voltage cable system in a power distribution system is disclosed. The connector system comprises: a first connector comprising a contact probe and a housing surrounding the probe and fabricated from a first material; and a second connector comprising: a shield; a contact element in the shield; and an insulative housing interface member fabricated from second material different from the first material, the interface member defining an outer engagement surface having a low coefficient of friction for sliding engagement with a mating connector, and an inner surface abutting the shield; and wherein the second material has a coefficient of friction that is less than the first material, and wherein the housing interface member is formed upon a surface of the shield.

Optionally, a leading end of the shield is encased in the housing interface member. The shield may be overmolded with the interface member. The housing interface portion may comprise an integrally formed indicating portion. The connector may comprise a middle section, with the middle section being provided with a semiconductive shield on an outer surface thereof.

A method of manufacturing a separable insulated connector for a power distribution system is also disclosed. The connector comprises a shield, and the method comprises: encasing at least a portion of the shield housing with a thermoplastic material; placing the overmolded shield housing in a rubber mold; and molding an elastomeric insulation to the overmolded shield.

Optionally, encasing a portion of the shield housing may comprise overmolding the shield with the thermoplastic material. The engagement surface may be fabricated from a material having a low coefficient of friction.

While the invention has been described in terms of various specific embodiments, those skilled in the art will recognize that the invention can be practiced with modification within the spirit and scope of the claims.

What is claimed is:

1. A separable insulated connector, comprising:

a conductive shield;

a contact element situated within the shield; and an insulative housing interface member formed on the conductive shield, the housing interface member being fabricated from a thermoplastic material, the housing interface member defining an engagement surface for sliding engagement with a mating connector, wherein the housing interface member extends interior to at least a portion of the shield.

2. The separable insulated connector of claim 1, wherein the engagement surface is fabricated from a material having a low coefficient of friction.

3. The separable insulated connector of claim 1, wherein the interface member is adapted to eliminate air gaps proximate the shield.

4. The separable insulated connector of claim 1, wherein the shield includes a first portion having a first diameter, and a second portion having a second diameter.

5. The separable insulated connector of claim 1, wherein a leading end of the shield is encased in the housing interface member.

6. The separable insulated connector of claim 1, further comprising an insulated elastomeric housing, a portion of the elastomeric housing in intimate contact with an exterior surface of the shield.

7. The separable insulated connector of claim 1, wherein the housing interface member comprises an indicating portion formed integrally with the housing interface member.

8. The separable insulated connector of claim 1, wherein the housing interface member comprises an inner surface, an outer surface, and a hollow portion between the inner surface and the outer surface, the hollow portion filled with an elastomeric material.

9. The separable insulated connector of claim 1, wherein the housing interface member comprises a corrugated surface.

10. The separable insulated connector of claim 1, further comprising at least one directional vent configured to expel gases away from an insertion axis of the connector.

11. The separable insulated connector of claim 1, wherein the shield is overmolded with the housing interface member.

12. The separable insulated connector of claim 1, wherein the shield comprises one of a shield housing and a contact tube.

13. The separable insulated connector of claim 1, wherein the housing interface member comprises at least one of polytetrafluroethylene, thermoplastic elastomer, and thermoplastic rubber.

14. The separable insulated connector of claim 1, further comprising a contact tube situated within the shield and containing the contact element, the contact tube being slidable relative to the interface member.

15. The separable insulated connector of claim 1, wherein the engagement surface comprises a conical bushing interface.

16. The separable insulated connector of claim 1, wherein the connector comprises a middle section, the middle section provided with a semi-conductive shield on an outer surface thereof.

17. The separable insulated connector of claim 16, wherein a first portion of the middle section is occupied by the housing interface member, and a second portion of the middle section is occupied by an elastomeric insulation.

18. The separable insulated connector of claim 16, further comprising at least one vent in the middle section.

19. A separable insulated connector for a medium voltage cable system in a power distribution system, the connector comprising:

a contact tube;

a conductive shield housing surrounding at least a portion of the contact tube; and an insulative housing interface member fabricated from a thermoplastic material, the housing interface member defining an outer engagement surface for sliding engagement with a mating connector, and an inner surface receiving a portion of the contact tube, wherein the housing interface member extends interior to at least a portion of the shield housing.

20. The separable insulated connector of claim 19, wherein a leading end of the shield housing is encased in the housing interface member.

21. The separable insulated connector of claim 19, wherein the housing interface member eliminates air gaps proximate the shield housing.

22. The separable insulated connector of claim 19, further comprising an insulated elastomeric housing, a portion of the elastomeric housing in intimate contact with an exterior surface of the shield housing.

23. The separable insulated connector of claim 19, wherein the housing interface member comprises an inner surface, an outer surface, and a hollow portion between the inner surface and the outer surface.

24. The separable insulated connector of claim 19, wherein at least one directional vent extends between the housing interface member and the contact tube.

25. The separable insulated connector of claim 19, wherein the shield housing is overmolded with the housing interface member.

26. The separable insulated connector of claim 19, wherein the thermoplastic interface comprises at least one of polytetrafluroethylene, thermoplastic elastomer, and thermoplastic rubber.

27. The separable insulated connector of claim 19, wherein the connector is a loadbreak connector.

28. The separable insulated connector of claim 19, wherein the outer engagement surface comprises a conical bushing interface.

29. The separable insulated connector of claim 19, wherein the engagement surface is fabricated from a material having a low coefficient of friction.

30. The separable insulated connector of claim 19, wherein the housing interface member comprises an indicating portion formed integrally with the housing interface member.

31. The separable insulated connector of claim 30, wherein the housing interface member comprises an interface shoulder and an interface surface, the indicating portion being situated proximate the interface shoulder.

32. The separable insulated connector of claim 19, wherein the connector comprises a middle section, the middle section provided with a semiconductive shield on an outer surface thereof.

33. The separable insulated connector of claim 32, wherein a first portion of the middle section is occupied by the housing interface member, and wherein a second portion of the middle section is occupied by an elastomeric insulation.

34. The separable insulated connector of claim 32, further comprising at least one vent in the middle section.

35. A separable insulated connector, comprising:

a conductive shield;

a contact element situated within the shield; and an insulative housing interface member formed on the conductive shield, the housing interface member being fabricated from a thermoplastic material, the housing interface member defining an engagement surface for sliding engagement with a mating connector, wherein the housing interface member comprises an inner surface, an outer surface, and a hollow portion between the inner surface and the outer surface, the hollow portion filled with an elastomeric material.

36. The separable insulated connector of claim 35, wherein the engagement surface is fabricated from a material having a low coefficient of friction.

37. The separable insulated connector of claim 35, wherein the interface member is adapted to eliminate air gaps proximate the shield.

38. The separable insulated connector of claim 35, wherein a leading end of the shield is encased in the housing interface member.

39. The separable insulated connector of claim 35, further comprising an insulated elastomeric housing, a portion of the elastomeric housing in intimate contact with an exterior surface of the shield.

40. The separable insulated connector of claim 35, wherein the housing interface member comprises an indicating portion formed integrally with the housing interface member.

41. The separable insulated connector of claim 35, wherein the housing interface member comprises a corrugated surface.

42. The separable insulated connector of claim 35, wherein the housing interface member comprises at least one of polytetrafluroethylene, thermoplastic elastomer, and thermoplastic rubber.

43. The separable insulated connector of claim 35, wherein the connector comprises a middle section, the middle section provided with a semi-conductive shield on an outer surface thereof.

44. The separable insulated connector of claim 43, wherein a first portion of the middle section is occupied by the housing interface member, and a second portion of the middle section is occupied by an elastomeric insulation.

45. The separable insulated connector of claim 43, further comprising at least one vent in the middle section.

46. A separable insulated connector, comprising:

a conductive shield;

a contact element situated within the shield; and an insulative housing interface member formed on the conductive shield, the housing interface member being fabricated from a thermoplastic material, the housing interface member defining an engagement surface for sliding engagement with a mating connector, wherein the housing interface member comprises a corrugated surface.

47. The separable insulated connector of claim 46, wherein the engagement surface is fabricated from a material having a low coefficient of friction.

48. The separable insulated connector of claim 46, wherein the interface member is adapted to eliminate air gaps proximate the shield.

49. The separable insulated connector of claim 46, wherein a leading end of the shield is encased in the housing interface member.

50. The separable insulated connector of claim 46, further comprising an insulated elastomeric housing, a portion of the elastomeric housing in intimate contact with an exterior surface of the shield.

51. The separable insulated connector of claim 46, wherein the housing interface member comprises an indicating portion formed integrally with the housing interface member.

52. The separable insulated connector of claim 46, wherein the housing interface member comprises an inner surface, an outer surface, and a hollow portion between the inner surface and the outer surface, the hollow portion filled with an elastomeric material.

53. The separable insulated connector of claim 46, wherein the housing interface member comprises at least one of polytetrafluroethylene, thermoplastic elastomer, and thermoplastic rubber.

54. The separable insulated connector of claim 46, wherein the connector comprises a middle section, the middle section provided with a semi-conductive shield on an outer surface thereof.

55. The separable insulated connector of claim 54, wherein a first portion of the middle section is occupied by the housing interface member, and a second portion of the middle section is occupied by an elastomeric insulation.

56. The separable insulated connector of claim 54, further comprising at least one vent in the middle section.

* * * * *